US006132554A

United States Patent [19]

Traise et al.

[11] Patent Number: 6,132,554

[45] Date of Patent: Oct. 17, 2000

[54] INTEGRATED COMPACT FOLDER/SEALER/INSERTER

[75] Inventors: John E. Traise, Melbourne, Fla.; Michael S. Kalisiak, North Tonawanda, N.Y.

[73] Assignee: Moore Business Forms, Inc., Grand Island, N.Y.

[21] Appl. No.: 08/470,706

[22] Filed: Jun. 6, 1995

[51] Int. Cl.[7] ..... B43M 3/02

[52] U.S. Cl. ..... 156/442.1; 156/555; 156/556

[58] Field of Search ..... 156/555, 556, 156/290, 291, 292, 298, 553, 548, 441.5, 442.1

[56] References Cited

U.S. PATENT DOCUMENTS

| | | | |
|---|---|---|---|
| 2,933,313 | 4/1960 | Stobb . | |
| 3,591,171 | 7/1971 | Schmidt . | |
| 4,033,807 | 7/1977 | Neill et al. | 156/384 |
| 4,034,845 | 7/1977 | Honegger . | |
| 4,245,832 | 1/1981 | Klenk et al. . | |
| 4,361,318 | 11/1982 | Stobb . | |
| 4,463,940 | 8/1984 | Mock . | |
| 4,817,369 | 4/1989 | Tribbey . | |
| 4,900,391 | 2/1990 | Mandel et al. . | |
| 4,905,977 | 3/1990 | Vijuk . | |
| 4,924,652 | 5/1990 | Krasuski et al. . | |
| 5,054,757 | 10/1991 | Martin et al. . | |
| 5,082,255 | 1/1992 | Brigante et al. . | |
| 5,169,489 | 12/1992 | Kalisiak et al. | 156/555 |
| 5,301,935 | 4/1994 | Miki et al. . | |
| 5,378,303 | 1/1995 | Traise . | |
| 5,409,207 | 4/1995 | Freeman . | |

*Primary Examiner*—Richard Crispino
*Attorney, Agent, or Firm*—Nixon & Vanderhye, P.C.

[57] ABSTRACT

An integrated system is provided for folding, inserting, pressure sealing, delivering, and optionally separating into different jobs, mailer type business forms. A common housing mounted by wheels supports in, or on, it: a folder for folding paper sheets with pressure activated adhesive to form to form pre-mailers; an inserter for receipt of pre-mailers from the folder and for placing insert sheets into the pre-mailers; a conventional pressure sealer module for pressure sealing pre-mailers to form mailer type business forms; and a delivery device for delivering stacked forms horizontally out of a bottom portion of the housing. A separator modification of the delivery device may be provided for receipt of sealed mailers to separate the mailers into different stacked groups. Typically the forms move generally downwardly during processing. The inserter includes a pair of reversible vacuum drums which grasp a folded paper sheet and move it apart to receive a substantially linearly driven insert. The separator includes parallel belt conveyor assemblies which can be reciprocated in a horizontal direction perpendicular to a stacking direction.

41 Claims, 6 Drawing Sheets

INTEGRATED COMPACT FOLDER/SEALER/INSERTER

BACKGROUND AND SUMMARY OF THE INVENTION

The production of mailer type business forms using pressure sealing equipment has been one of the most significant advances in the mailer art in many years. There are now a number of well known commercial products manufactured by Moore Business Forms, Inc. of Lake Forest, Ill. which successfully perform this function, including the Moore 8158/4800 system, and the Moore 4400 and 4420 systems, such as generally shown in U.S. Pat. Nos. 5,397,427 and 5,378,303, and in co-pending application Ser. No. 07/605,797 filed Oct. 31, 1990. While these systems are enormously successful in performing their intended functions, there are expected limitations in the further development of these systems due primarily to the combined requirements for floor space, weight, and relatively high cost, which limit the lower-end utilization of this technology. For example the extremely versatile and successful 8158 folder/4800 sealer system combines two or three separately developed and manufactured machines into a processing line which requires a combined floor space "footprint" of up to 80 square feet, and which weighs over a thousand pounds.

According to the present invention, a system, system components, and methods are provided which take advantage of the numerous benefits of the Moore pressure sealing systems but in a manner designed to accommodate needs of the lower-end utilization of this technology. The system according to the present invention is much smaller than most complete conventional systems, integrating into a single machine module a folder, inserter, pressure sealer, and separator. The machine easily accomplishes the basic folding and sealing functions, and optionally allows passive or intelligent insertion, mark sensing or bar-code reading for batch separation at the delivery end (or for audit control), postal franking, and/or other features which individual users can install and use for typical mailing or processing requirements, all with the same basic integrated system.

One way in which the invention can readily accomplish the desired functions in an integrated system is its utilization of a generally downward feed of the forms and form elements. At the bottom of the integrated system, the forms are delivered in a horizontal direction in stacks that are vertically oriented. A common motor drive may be provided for the folder and the sealer. The entire system is mounted in or on a common housing which is portable, capable of being rolled from place to place by just one worker, and weighing only ⅙–⅓ as much as conventional commercial systems capable of folding, pressure sealing, and insertion.

According to one aspect of the present invention an integrated system for folding, inserting and pressure sealing mailer-type business forms is provided. The system comprises the following elements: A common housing mounted on movable elements (such as castors, wheels, rollers, or slides), the common housing mounting in or on it: A folder for folding paper sheets with pressure-activated adhesive to form pre-mailers. An inserter mounted for receipt of pre-mailers from the folder for inserting insert elements into the pre-mailers from the folder within areas thereof defined by the pressure-activated adhesive. A pressure sealer module mounted for receipt of pre-mailers from the inserter for pressure sealing the pre-mailers to form mailer type business forms. And, a delivery device for delivering sealed forms in one or more stacks. The system also optionally comprises a job separator mounted for receipt of sealed mailers from the pressure sealer to separate the mailers into different stacked groups, or alternatively a simple conveyor system may be utilized to discharge a single stack of sealed mailers. The integrated system is especially effective by providing a generally downward feed of the folded sheets, inserts, and completed mailers, allowing inserts and folded sheets to be readily provided at the top of the unit, and the stacked mailers to be withdrawn from a readily accessible horizontally disposed conveyor.

The folder utilized in the integrated system according to the invention may comprise any conventional compact folder which is capable of feeding and pattern folding into Z, C, and/or V configurations. Particularly desirable are buckle folders equipped with either "on demand" feed initiation of each sheet, or with uniformly spaced infeed separation of each sheet. An example of the "on demand" feeder unit is the feeder on the M-B 8158 folder. An example of a folder with a uniformly spaced infeed separation of each sheet is a Brusko reciprocating shoe feeder. One particularly desirable folder that may be utilized is a M-B model 3482 auto-set folder with bottom feed, the only modification to that design that is necessary being the elimination of the final delivery conveyor.

The folder is capable of folding paper sheets with pressure-activated adhesive such as the type used in conventional pressure sealing equipment such as sold by Moore Business Forms, Inc. of Lake Forest, Ill., and as described in U.S. Pat. No. 5,378,303 (the disclosure of which is hereby incorporated by reference herein). The pressure sealer module utilized according to the present invention is also preferably substantially exactly what is shown in U.S. Pat. No. 5,378,303, marketed as the model 4420 "Piano-Key" sealer by Moore Business Forms. The major difference between the sealer according to the invention and the 4420 is that the sealer according to the present invention is mounted in a vertical orientation so the documents proceed downwardly from an insertion station through the sealer, and then to the diverter and delivery stations. [However any conventional arrangement of pressure rollers (such as the roller assemblies per se in U.S. Pat. No. 5,397,427 and co-pending application Ser. No. 07/605,797) may be utilized.]

The preferred inserter provided is preferably a unique inserter according to the present invention which provides redundant error-detection, and speed and position matching techniques to effectively feed an insert into the primary document in an effective and space-saving manner. In the preferred embodiment the inserter comprises the following components: First and second vacuum drums mounted for rotation about substantially parallel axes and each having a peripheral surface. First and second rollers. At least one conveyor element extending between the peripheral surface of each of the first and second vacuum drums and the first and second rollers, respectively, conveyor elements from each of the first and second vacuum drums and rollers in operative association with each other to convey a business form therebetween. Means for rotating the vacuum drums about the axes so that both of the vacuum drums are rotatable clockwise and counterclockwise. At least one sensor for sensing the position of a business form with respect to the vacuum drums. And, means for directing an insert element into a business form between the vacuum drums and held thereby.

The inserter as described above includes a plurality of particularly mounted sensors typically which sense the paper edges of the insert and business form into which the insert is provided, to monitor the correct sheet position. This provides effective error detection, redundant at every step, which assures the clean operation of the components in order to prevent destructive jams which might mutilate the forms and cause down time of the equipment. Input scanning logic, either by intelligent mark or bar-code reading, may be used to initiate the inserter operation, or if intelligent scanning is not necessary simple primary document counting or sensing may be utilized to initiate the cycle. Typically the first drum periphery is above the second drum periphery and the inserter above the second drum periphery, and the drums are powered together so that when one rotates counterclockwise the other rotates clockwise, and vice versa. Guides are provided between the drums and from the folder and inserter to guide the various components into proper orientation, and rollers associated with the drum surfaces may extend through or adjacent the guides to facilitate holding of the form elements on the drums. A computer controller is preferably provided for controlling all of the operations, and there is a downward orientation of belts from the drums so that the forms are moved downwardly into the vertically oriented (downwardly directed) pressure sealer.

The invention also relates to a method of inserting an insert element, having a leading edge, between first and second business form flaps having a first end at which the flaps are attached to each other, and a second open end opposite the first end, such as a single sheet of paper that has been V or Z folded. The method comprises the steps of automatically: (a) Moving the business form flaps from an initial position in a first direction, with the first end leading, until the first end is in a first position. Then, (b) engaging the first and second flaps, and moving the business form first end from the first position in a second direction substantially opposite the first direction, while simultaneously moving the first and second flaps apart, until a second position is reached. (c) Feeding an insert element in a third direction, different from the first and second directions, so that the leading edge thereof moves between the first and second flaps into a third position particularly located with respect to the first end of the business form. And, (d) after steps (b) and (c), moving the flaps first end in the first direction while simultaneously moving the flaps together so that they substantially surround the insert element.

The method typically also includes the step of sensing the leading edges of the insert sheet and the flaps, and the various movements of the components are effected automatically in response to that sensing. Also the components are positively guided during movement. The insert sheet is inserted substantially linearly, contacting only the second flap until the leading edge thereof engages the first flap.

Downstream of the pressure sealer in the direction of form movement, a delivery device is provided for delivering the sealed forms in one or more stacks. In the simplest embodiment, first and second conveyors merely move the forms downwardly from the pressure sealer, then deflect them a small amount in a first horizontal direction, while continuing to move them downwardly, and then vertically stack them on an intermediately moving conveyance surface after deflection and downward movement into contact with the conveyance surface. This results in delivery of a vertical stack of forms in a horizontal direction from the housing of the integrated system.

Under some circumstances it is desirable to separate the forms into different jobs. This may be accomplished by utilizing a more complex and sophisticated form of the delivery device just described above. The separator so provided—while preferably used in the integrated system according to the invention—may have other uses as a separator for other types of business form equipment.

According to another aspect of the present invention a separator for separating business forms into displaced groups of forms that is provided comprises the following components: A first conveyor assembly comprising first and second substantially parallel rollers, and rotatable about axes, with at least one endless conveyor element extending between them. A second conveyor assembly comprising first and second rollers substantially parallel to each other and to the first conveyor assembly rollers, and rotatable about axes, with at least one endless conveyor element extending between them. The first and second conveyor assemblies mounted so that the conveyor elements thereof are substantially in face to face engagement with each other, for conveying a business form between them in a first direction. A third conveyor assembly comprising a deflecting element for deflecting the leading edge of a business form exiting the first and second conveyor assemblies in the first direction to move in a second direction substantially perpendicular to the first direction, and then to continue conveyance in the first direction, the third conveyor assembly mounted immediately adjacent the first and second conveyor assemblies for receiving a business form conveyed thereby in the first direction. A fourth conveyor assembly comprising a conveyance surface substantially perpendicular to the first direction and movable in the second direction, the conveyance surface cooperating with the third conveyor assembly to stop movement of a business form in the first direction. And, means for shifting at least the first rollers of the first and second conveyor assemblies along their axes of rotation to displace them in a third direction substantially perpendicular to both the first and second directions.

In the separator described above the third conveyor assembly preferably comprises a continuation of the second conveyor assembly, including having conveyor elements (e.g. tapes) in common. Also the second roller of the first conveyor is preferably mounted so that it is at the top of the forms as they are moved in the stack, so as to impart an initial horizontal (in the correct direction) movement to the top of each sealed mailer, in succession, to facilitate the stacking and conveyance action. A sensor is typically provided before the first and second conveyors for reading bar-coding or other indicia on the mailer so as to determine when a particular job is over and when the shifting means should be operated, the entire drive components associated with the separator typically being controlled by the same computer controller as described above with respect to the inserter. Typically the conveyance surface of the fourth conveyor assembly comprises conveyor tapes which are spaced from each other in the third direction, and intermeshed with conveyor tapes from the third conveyor, the conveyor tapes from the third conveyor being elastic. A movable back stop also preferably comprises part of the fourth conveyor assembly, mounted on the conveyance surface for guided movement therealong.

The invention also relates to a method of separating different groups of business forms by, at spaced time intervals, displacing them. The method comprises the following the steps: (a) One after the other, moving the business forms in a first direction with a leading edge of each business form in the first direction. (b) Deflecting the leading edge of each business form, in sequence, so that it moves in a second direction, substantially perpendicular to the first direction, and then continues movement in the first direction. (c) Terminating movement of each business form, in sequence, in the first direction so that a stack of business forms is formed extending in the second direction with the leading edges thereof perpendicular to the second direction. (d) At spaced time intervals, displacing the business forms in a third direction, substantially perpendicular to both the first and second directions, so that they when they are moved in the first direction they are displaced in the third direction, to form a displaced stack of business forms extending in the second direction. And, (e) accommodating the increase in the size of the stack, and displaced stack, in the second direction.

The first direction in which the forms are moved is preferably downward. Step (e) is typically practiced at spaced time intervals moving forms in the stack in the second direction. Sensing of the forms is typically accomplished in order to effect step (d). The forms are preferably mailer-type business forms from a sealer, such as a pressure sealer.

It is the primary object of the present invention to provide for the compact, simple, yet effective folding, sealing, and optional insertion and job separating, handling of business forms, particularly mailer-type business forms. This and other objects of the invention will become clear from an inspection of the detailed description of the invention and from the appended claims.

DETAILED DESCRIPTION OF THE DRAWINGS

Figure 2:
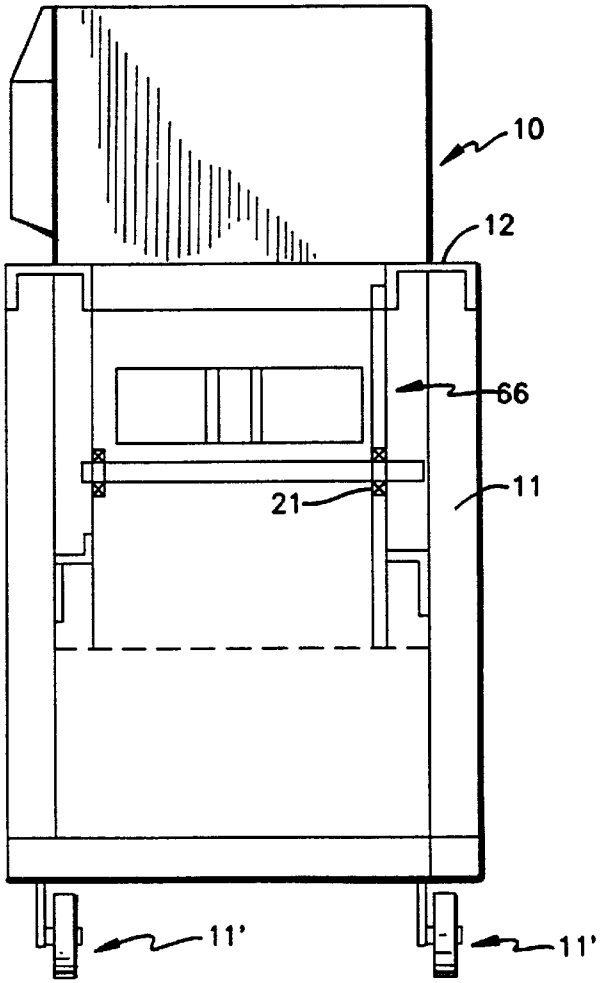
FIG. 2 is a rear view, with portions of the housing cut away for clarity of illustration, of the system of FIG. 1.
Figure 1:
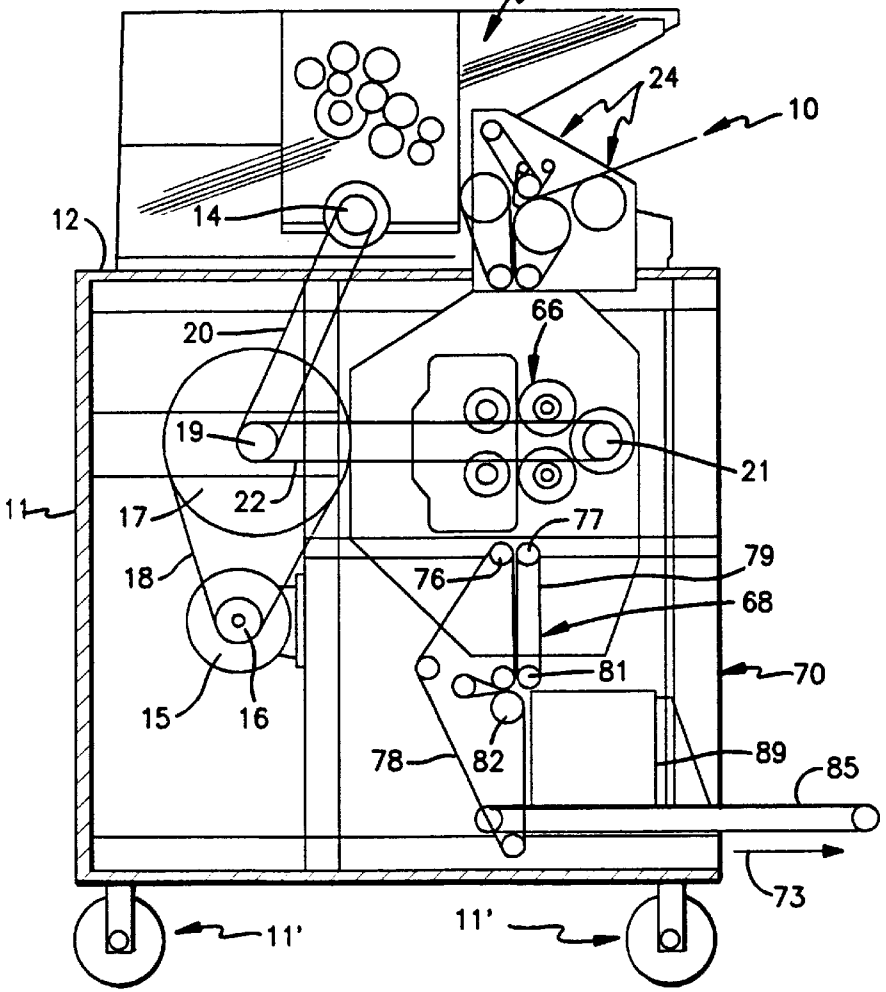
FIG. 1 is a side schematic view of an exemplary compact integrated system for folding, inserting, pressure sealing, delivering, and optionally separating, of mailer-type business forms according to the present invention.

An integrated system according to the present invention is shown generally by reference numeral 10 in FIGS. 1 and 2. The system 10 includes a common housing 11 mounted on movable elements 11'. While the movable elements 11' are illustrated as wheels in FIGS. 1 and 2, it is to be understood that they can be any structure for facilitating the portability of the housing 11, such as castors, rollers, slides, glides, tractors, bearings, air cushion devices, or the like. The common housing 11 may include a top surface 12 which mounts various structures on it, while other structures are mounted within the common housing 11, 12.

Figure 9:
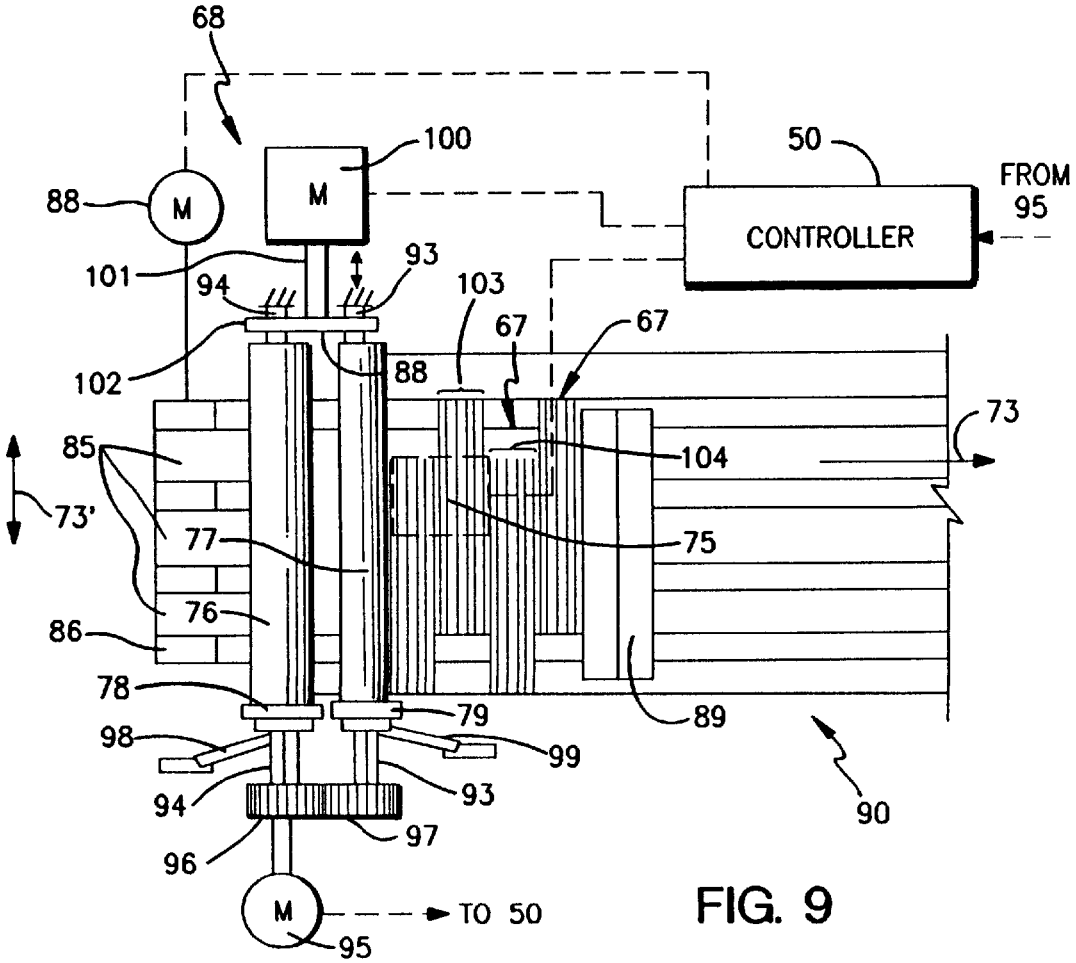
FIG. 9 is a top schematic view, with some portions cut away for clarity of illustration, of the device of FIG. 7 with modifications thereof to perform a job separating function.

The major components of the system 10 include the folder 13, the inserter 24, the pressure sealer 66, the delivery device 68, 70 (all seen in FIG. 1), and if desired a separator (a modification of the device 68, 70 as seen in FIG. 9).

The folder 13 is illustrated only generally in FIG. 1 because the details of the folder mechanism 13 are not part of the present invention. Any conventional technology suitable folder may be utilized, such as a buckle folder equipped with either on-demand feed initiation of each sheet (such as an M-B 8158 folder), or with uniformly spaced infeed separation of each sheet (such as a Brusko reciprocating feed shoe feeder). For example the device 13 may be an M-B model 342 auto-set folder with bottom feed, the only modification necessary to this conventional device being to eliminate the final delivery conveyor which is not necessary in the system 10 according to the invention.

The drive shaft for the entire folder 13 is illustrated schematically at 14 in FIG. 1, and is driven by a motor 15 (such as an AC electric, pneumatic, or the like motor) having a drive pulley or sprocket 16 which is connected by belt or chain 18 to a drive pulley or sprocket 17, which in turn drives a gear or pulley 19 connected by a chain or belt 20 to the drive shaft 14, with a second portion thereof connected to the common drive shaft 21 for the pressure sealer module 66 by a belt or chain 22. The motor 15 is mounted within the housing 11, while the folder 13, and drive shaft 14 thereof, are mounted on top of the upper surface 12 of the housing 11. The motor 15 may also, if suitable gearing, drive, and the like components are practical, be used for powering one or more aspects of the inserter 24 and delivery device 68, 70 under some circumstances.

Figure 3:
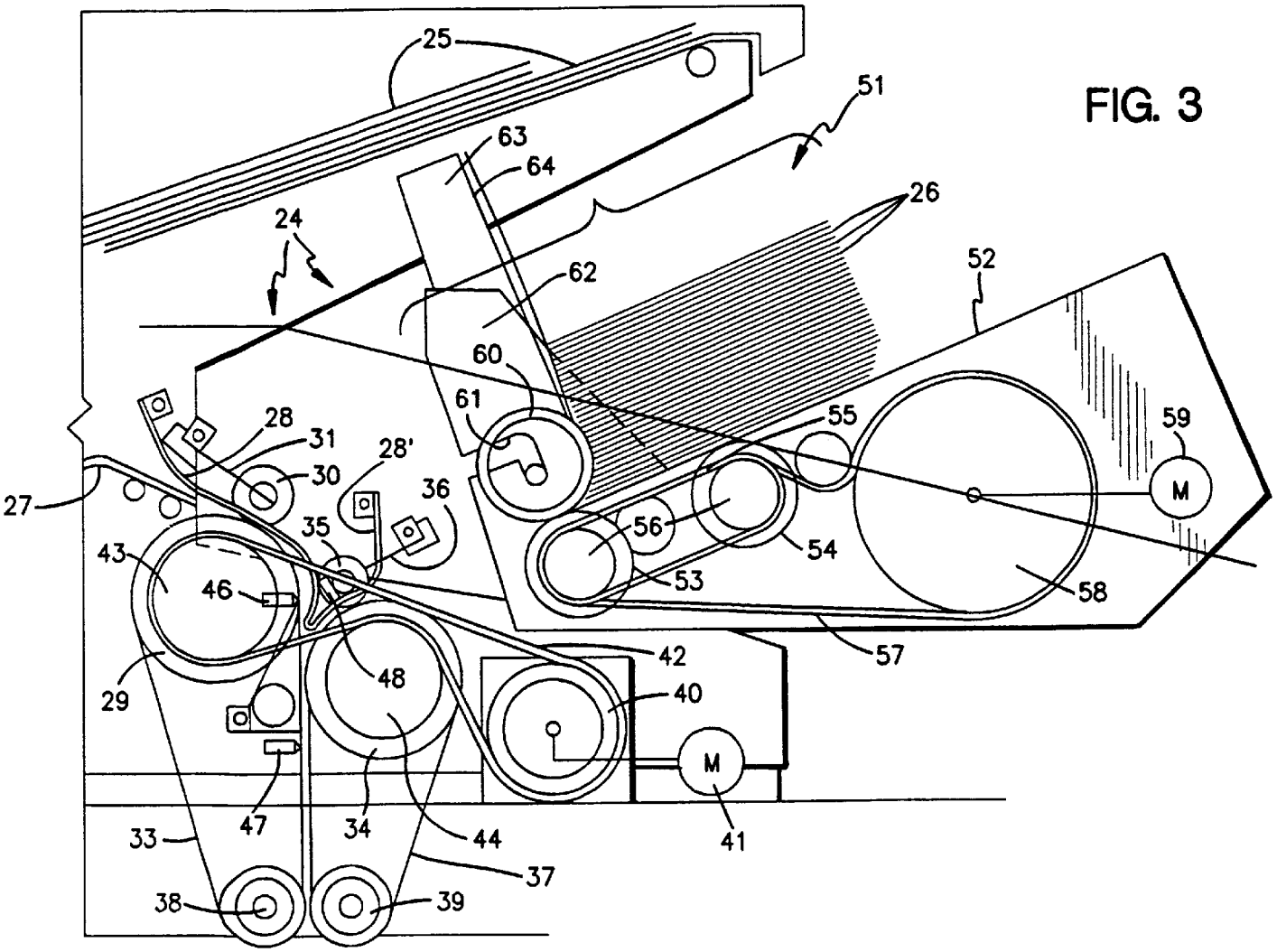
FIG. 3 is a side detail view of the inserter component of the system of FIG. 1.
Figure 4:
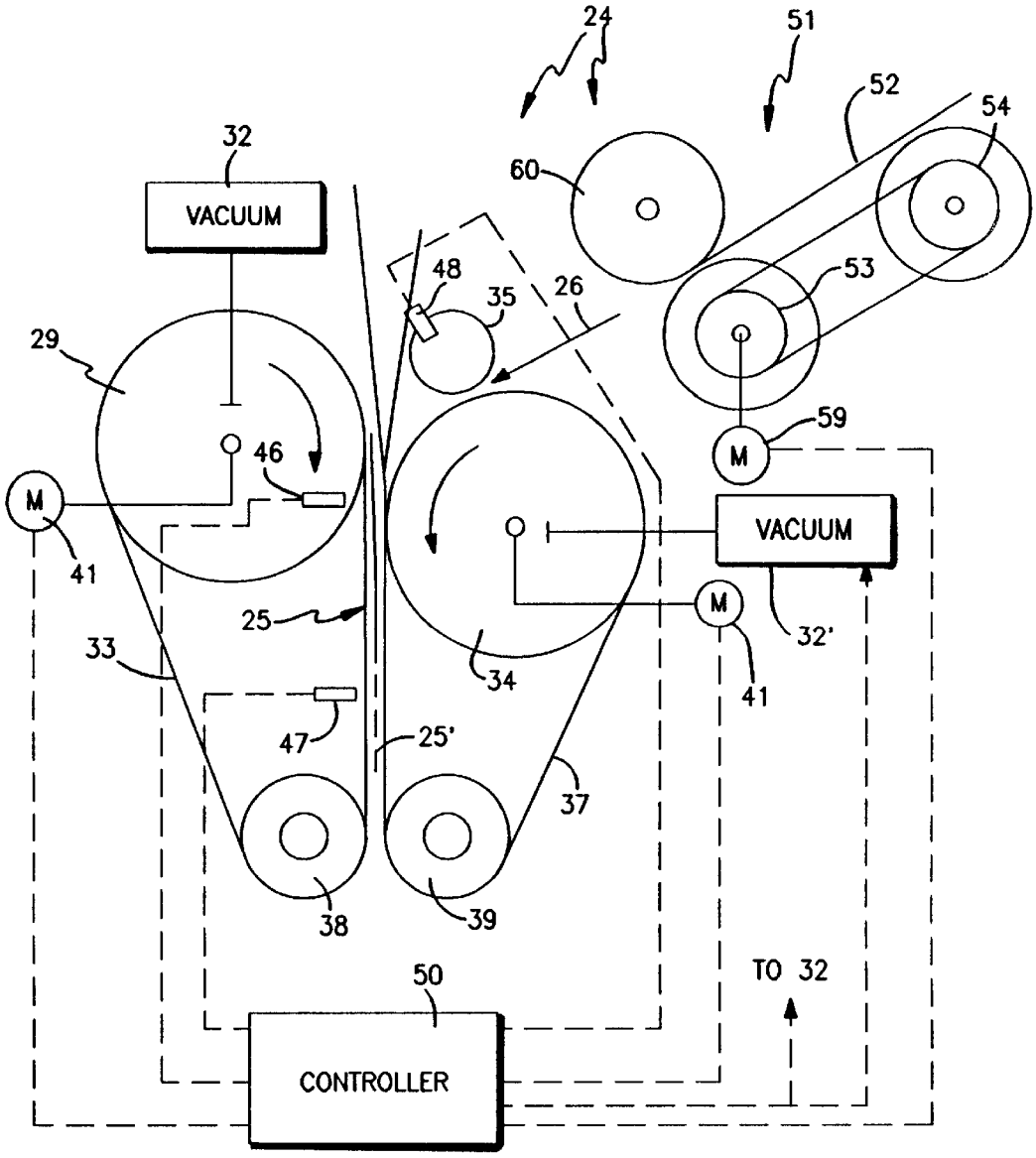
FIG. 4 is a schematic detail view showing the connection of the components illustrated in FIG. 3 to various sources of vacuum, motors, and a controller, in the practice of the method of insertion according to the present invention.
Figure 5:
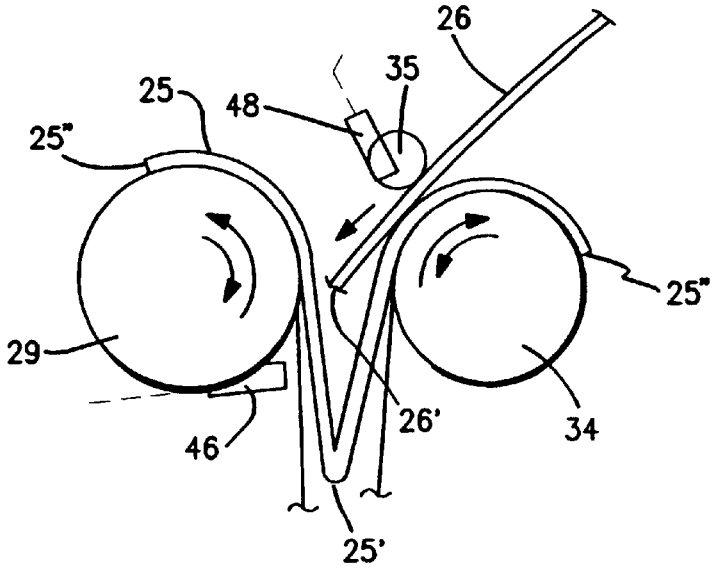
FIG. 5 is a detail view of the vacuum drum of the system of FIG. 4 during the actual insertion operation showing the various locations of the component parts, with the components being schematically seen in more widely spaced than in reality for clarity of illustration.
Figure 6:
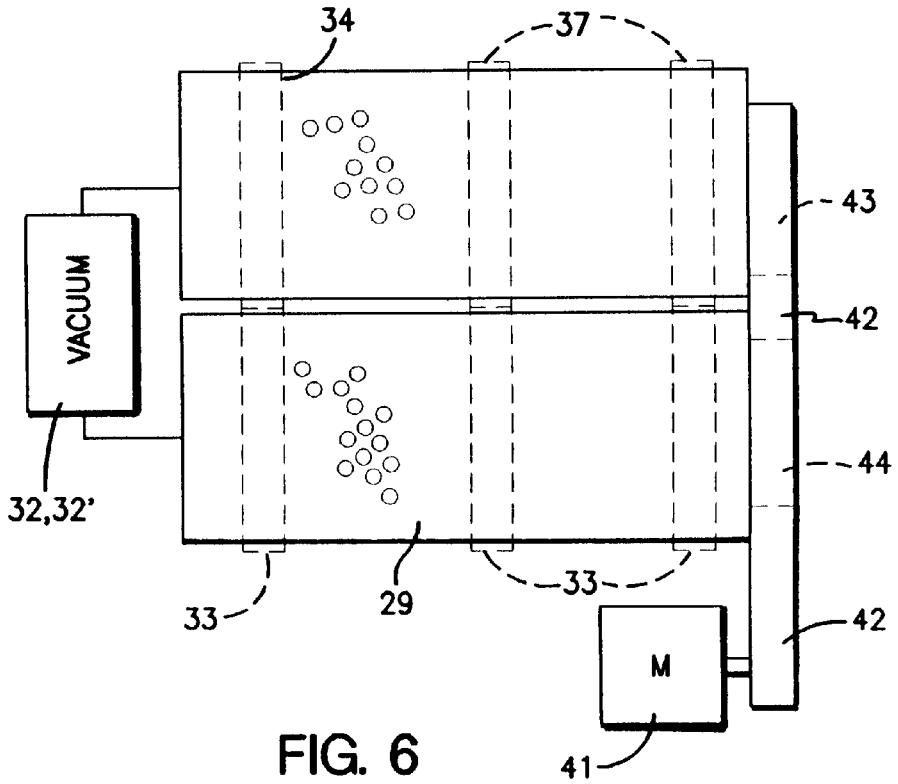
FIG. 6 is a top plan view of the vacuum drums, with schematic connection to a motor, of the system of FIGS. 3 through 5, showing the conveyor tapes in dotted line.
Figure 8:
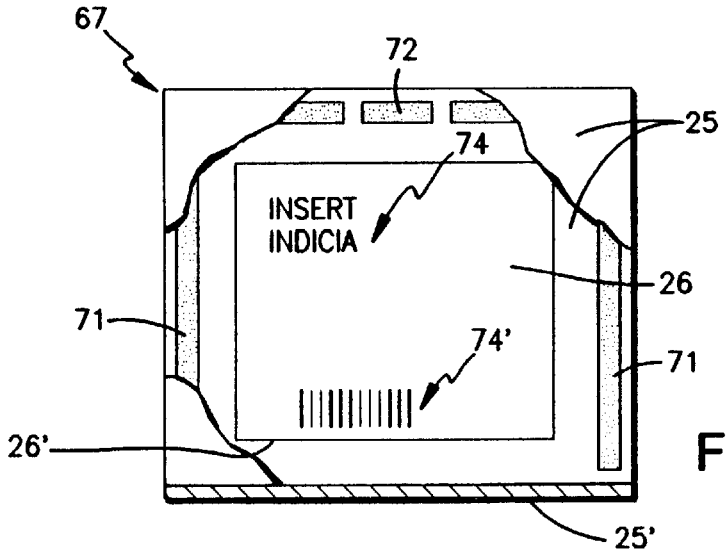
FIG. 8 is a side view, with portions of one of the outer sheets cut away for clarity of illustration, of an exemplary sealed mailer-type business form produced according to the present invention.

The inserter 24 in general is seen most clearly in FIG. 3, while various aspects thereof are schematically illustrated in FIGS. 4 through 6 to facilitate understanding of the operation thereof. The inserter 24 operates on pre-mailers delivered by the folder 13. The folder 13 typically takes paper sheets 25 (see FIG. 3 with pressure activated adhesive thereon, as will be described later with respect to FIG. 8) and after they are V, Z, or even C folded by the conventional folder 13, inserts one or more insert elements between flaps of the sheets 25. The insert elements 26 preferably comprise single printed sheets, although they may comprise folded sheets, multiple sheet elements releasably tied or affixed together, or even packets of material. In FIG. 3 the elements 26 are illustrated as single insert sheets, and an insert sheet 26 in association with a folded sheet 25 is illustrated in FIG. 8.

As seen in FIG. 3, guide elements 27, 28 (including the portion 28' thereof) are provided for guiding various components. For example a folded sheet 25 first exiting the folder 13 passes between the guide elements 27, 28 generally to the right and downwardly as seen in FIG. 3 toward a first vacuum drum 29. The guide elements 27, 28 are preferably shaped pieces of sheet metal, and the upper guide element 28 preferably includes a plurality of apertures therein for receipt of hold down rollers 30 (only one of which is seen in FIG. 3) each mounted by a cantilever spring 31 to a stationary support, for facilitating holding the folded sheet 25 in contact with the vacuum drum 29 circumferential periphery. As schematically illustrated in FIG. 4, the first vacuum drum 29 is connected to a source of vacuum 32, the vacuum drum 29 per se being well known in the general art of handling sheets and webs.

The inserter 24 also typically comprises a plurality of spaced (along the generally horizontal axis of rotation of the drum 29) conveyor tapes 33 or like conveyor elements (such as belts, strands, or the like), a second vacuum drum 34 having a plurality of hold down rollers 35 associated therewith mounted by cantilever springs 36, and a plurality of tapes 37 or the like corresponding to the tapes 33. As seen in FIG. 3, the hold down rollers 35 extend through apertures in the portion 28' of the guide element, which guide portion 28' guides an insert 26 into operative association with the second vacuum drum 34. The rollers 38, 39 cooperate respectively with the first and second vacuum drums 29, 34, the second drum 34 connected up to a source of vacuum 32' (see FIG. 4) which may be the same as the source 32.

In the preferred embodiment of the invention illustrated in FIGS. 3 through 6, the vacuum drums 29, 34, are of approximately the same size (in fact are substantially identical), mounted for rotation about substantially parallel horizontal axes, and the first drum 29 axis of rotation is above and to the left of the second drum 34 axis, as seen in FIG. 3. For example as seen in FIG. 3, the drum 29 axis is mounted substantially at or vertically above the upper periphery of drum 34. As is conventional—as seen in FIG. 6—the circumferential peripheries of the vacuum drums 29, 34 are perforated.

A common drive mechanism is provided for driving drums 29, 34, including a drive pulley or sprocket 40 driven by a motor 41, and connected by a chain or belt 42 to the pulley or sprocket 43 and pulley or sprocket 44, the pulleys or sprockets 43, 44 being mounted on the drums 29, 34 for rotation therewith, and to drive those drums. Note that the elements 40 through 44 are positioned with respect to each other (as seen in FIG. 3) so that when the first drum 29 rotates clockwise the second drum 34 rotates counter clockwise, and vice versa, and it is important that the motor 41 be a reversible motor since the drums 29, 34 are driven both clockwise and counter clockwise during a normal inserting operation. Note also that the rollers 38, 39 are mounted with respect to the drums 29, 34 so that a sheet 25 may pass therebetween driven by the tapes 33, 37, ultimately downwardly, but during parts of the operation also upwardly.

The inserter 24 also includes a plurality of sensors associated therewith, such as the sensors 46, 47, 48 which are seen in FIGS. 3 and 4. The sensors 46–48 may be any suitable sensors, such as optical sensors, bar-code readers, magnetic sensors, or a wide variety of other types depending upon exactly what is to be sensed thereby. The sensors 46, 47 sense the folded sheet 25, while the sensor 48 senses the insert 26. While the positions and number of sensors 46–48 may vary widely, preferably sensor 46 is mounted at the level of said first drum 29, and the sensor 47 is mounted roughly mid-way between drum 29 and roller 38.

FIG. 4 schematically illustrates the inter-connection of the various components that control operation of the inserter 24. The sensors 46 through 48 provide input to a controller 50, such as a conventional computer controller, which in turn controls the motor 41 and even the vacuum sources 32, 32' under some circumstances, if desired, as well as other devices (described below).

The actual insertion mechanism for inserting the inserts 26 into association with the folded sheets 25 is illustrated schematically at 51 primarily in FIGS. 3 and 4, and includes a support surface 52 which is substantially linear and supports a stack of inserts 26 thereon. As seen in both FIGS. 3 and 4, it is desired that the surface 52 make an angle of roughly about 60 to 70° with respect to the vertical, so that the sheets 26 are not horizontal but rather sloped downwardly toward the guide 28' and vacuum drum 34. The structure 51 also includes a drive roller 53 having a peripheral surface thereof mounted on the linear continuation of the support surface 52 which engages the bottom of an insert 26 and is driven as illustrated schematically in FIG. 4 between the periphery of the vacuum drum 34 and the hold down rollers 35. A second roller 54, also a drive roller, is provided which is driven in the same direction (counter clockwise as viewed in FIG. 3 when feeding an insert 26), for example the rollers 53, 54 being synchronized for movement together by a belt 55 cooperating with the pulleys 56 thereof, the pulleys 56 further cooperating with a common belt 57 which is driven by a pulley 58 connected to a motor 59. The motor 59 need not be reversible, although it may be, and powers the rollers 53, 54 together via the common belt 57 and pulleys 56, 58.

In order to ensure that only one insert 26 is dispensed at a time, a conventional cooperating roller 60, which is an idler roller, is pressed primarily by gravity into contact with the periphery of the drive roller 53, the shaft of the inserts-separating roller being received within the cutout 61 in the metal support structure 62. Structure 62 is in turn connected to another metal support 63 including a surface 64 thereof which engages the lead edges 26 (see FIG. 5) of the stack of inserts 26.

The preferred manner of operation of the inserter 24 is perhaps seen best with respect to FIGS. 4 through 6. A sheet 25, folded into a V or Z fold orientation (a Z fold orientation is illustrated in FIGS. 4 and 5, but it is to be understood that other fold configurations are also possible not only Z folds but also C folds) with the leading edge 25' going into the nip between the drums 29, 34 and the belts 33, 37 thereof, guided by the guides 27, 28. The power for moving the folded sheet 25 generally downwardly is initially provided by the folder 13, but once the leading edge 25 is between the drums 29, 34 it is completely free of the influence of the folder 13.

As the folded sheet 25 passes downwardly, the leading edge 25' thereof moves past detector 47 and is sensed, and once the trailing edge of the left flap portion 25 thereof (see FIGS. 4 and 5) is detected by the sensor 46 the insertion action is ready to begin, the initial feeding merely ensuring proper positioning of the folded sheet 25 with the sensors 46, 47—through the controller 50—specifically determining the position of the folded sheet 25, establishing document length, verifying integrity and accuracy of the entire feeding operation, and initiating the insertion cycle.

When the folded sheet 25 is moved downwardly to the approximate position of where the trailing edges thereof are detected by sensor 46, those trailing edges are in contact with the perforated peripheries of the vacuum drums 29 (for the left flap of the folded sheet 25 as seen in FIGS. 4 and 5) and 34 (for the right flap as seen in FIGS. 4 and 5), the vacuum source 32, 32' causing the flaps of the folded sheet 25 to snap into engagement with the drum peripheries 29, 34. Then the entire downward movement of the folded sheet 25, powered by the motor 41 driving the drums 24, 34, stops, the motor 41 reverses, and the trailing edges 25" of the folded sheet 25—see FIG. 5—become the leading edges, and as the folded sheet 25 now moves upwardly the left and right flaps thereof are held to the drums 29, 34, respectively, as the drum 29 rotates counter clockwise and the drum 34 clockwise (see FIG. 5). This thus "opens up" the folded sheet 25, and generally upward movement of the sheet 25 is stopped once a position is reached just past the position illustrated in FIG. 5.

Simultaneously with the upward movement of the sheet 25 to "open up" the upper end thereof, an insertion occurs once the sheet 25 is opened for a major portion of its length (as seen in FIG. 5). The actual feeding of an insert 26 may be occasioned by the sensor 46 sensing a mark, bar-code, or the like on a portion of the sheet 25, but in any event regardless of how operation of the insertion device 51 is initiated, (that is whether by counting, sensing, timing, or the like) the bottom insert 26 supported on the support 52 is fed by the rollers 53, 54 generally linearly downwardly toward the nip between the drum 34 and the rollers 35, guided by the guide 28'. The leading edge 26' (see FIG. 5) of the insert 26 is sensed by sensor 48. The rollers 53, 54 are driven by the motor 59. Note that the motors 41, 59 preferably are identical stepper motors both controlled by the controller 50 (see FIG. 4) so that both distance processed and sheet speed of the folded sheet 25 and the insert 26 are synchronous.

The insert 26 is fed in the direction of the arrow illustrated in FIG. 5, generally downwardly, until it is in the proper position with respect to the folded sheet 25, typically in contact with the right flap of the folded sheet 25 as illustrated in FIG. 5, and when the leading edge 26' thereof contacts the left flap. In this position it is preferably properly positioned in a pre-mailer which ultimately forms the mailer 67, within the patterns (e.g. continuous or discontinuous strips, or shaped circular spots or polygonal shaped elements) of pressure activated adhesive 71, 72, as illustrated in FIG. 8. Note that the insert 26 typically has human readable indicia 74 associated therewith as well as bar-coding 74' or other machine readable indicia which also may be sensed by the sensor 48 or another properly positioned sensor.

Once the insert 26 is properly positioned within the folded sheet 25, motor 41 is again reversed so that the drum 29 is driven clockwise and the drum 34 counter clockwise, and the conveyor elements 33, 37 drive the pre-mailer (combination of unsealed folded sheet 25 and insert 26) generally downwardly. Once the pre-mailer moves past the rollers 38, 39 it moves into operative association with the rollers of the pressure sealer module 66.

While in the preferred embodiment an insert 26 is provided within each mailer 67, of course the system 10 can be operated without using the inserter 24, for example by turning the motor 59 off, and by operating the controller 50 so that the sensors 46–48 are disabled and the motor 41 always operates to move the folded sheets 27 downwardly in sequence.

The module 66 is not shown in detail in FIG. 1 because it is per se conventional, except for its vertical orientation. The pressure module 66 is preferably as disclosed in U.S. Pat. No. 5,378,303, or substantially the same as the Moore 4420 "Piano Key" sealer presently marketed. The sealer 66—by pressure—activates the adhesive of the patterns 71, 72 (FIG. 8) to provide a sealed mailer 67.

Figure 7:
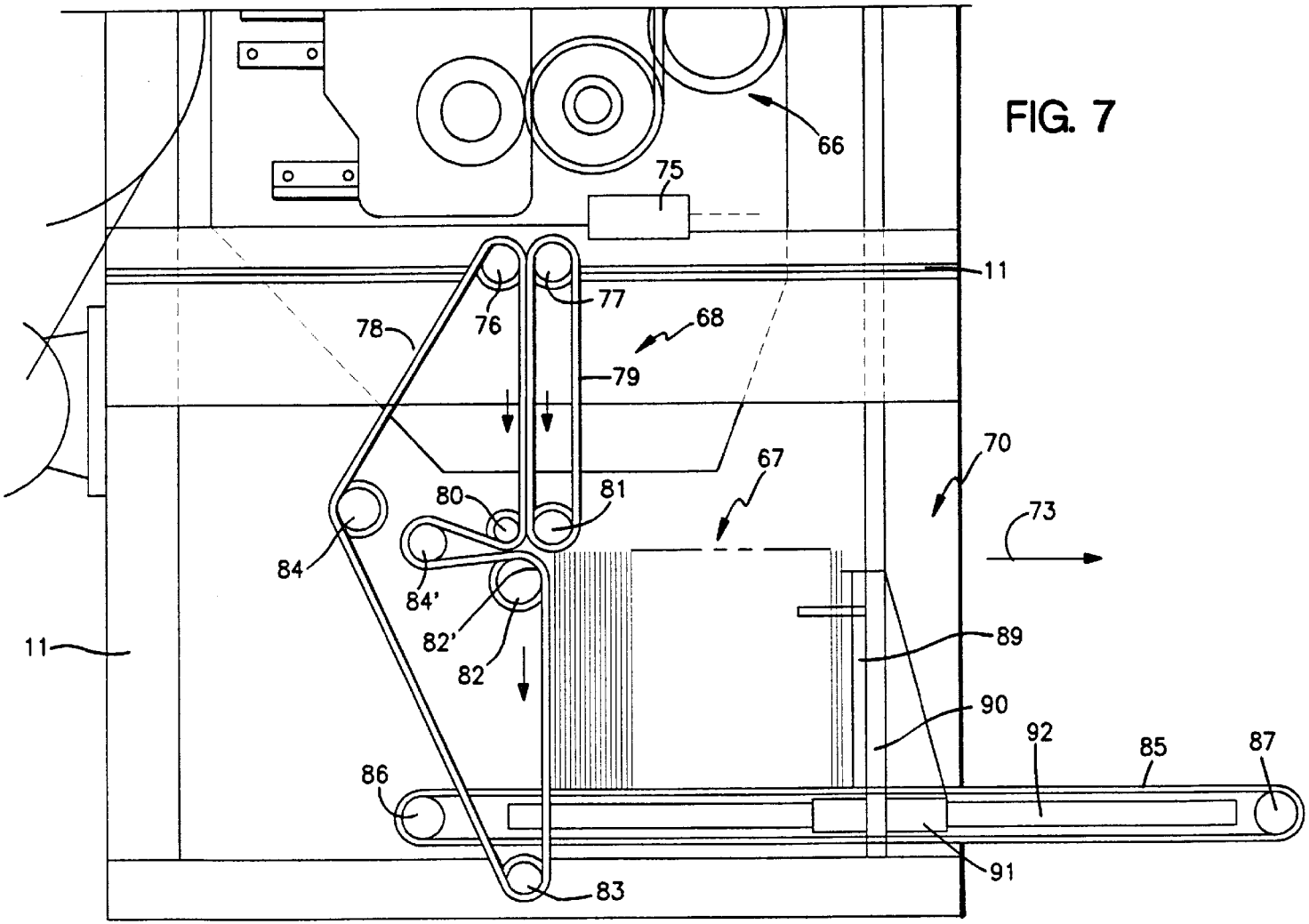
FIG. 7 is a detail side view of the exemplary delivery device, which may also function as a job separator, of the system of FIG. 1, downstream of the pressure sealer.

Below the pressure sealer 66 is the delivery device 68, 70 which transforms the individual sealed mailers 67 into a vertical stack of mailers (see FIG. 7) that horizontally exits the housing 11 by moving in the direction of arrow 73 as seen in FIG. 7. As also be hereinafter further described, the delivery device 68, 70 can also be configured and operated as a job separator.

The delivery device 68 preferably includes a first conveyor assembly and a second conveyor assembly both mounted just below the pressure sealer 66 and a sensor 75 (e.g. optical sensor, bar-code reader, magnetic sensor, or the like) for detecting each mailer 67 as it is discharged by the sealer 66, either to count the mailers, separate them into jobs, or merely verify their proper delivery to ensure that there is no machine jam. Rollers 76, 77 cooperate with conveyor elements 78, 79 and rollers 80, 81. The first conveyor assembly comprises the rollers 77, 81 and the endless conveyor elements 79, while the second conveyor assembly comprises the rollers 76, 80, and the endless conveyor elements 78. The conveyor elements 78, 79 preferably comprise spaced conveyor tapes spaced from each in a horizontal dimension 73' substantially perpendicular to the direction 73 (see FIG. 9). However the elements 78, 79 may comprise belts, chains, bands, or a wide variety of other structures. The elements 78, 79 are preferably round in cross-section urethane (elastic) conveyor tapes.

The delivery device 68 also includes a third conveyor assembly which includes the rollers 82, 83 as well as the rollers 84, 84'. In the preferred embodiment illustrated in FIG. 7, the same conveyor elements 78 are associated with the second conveyor mechanism and the third conveyor mechanism formed by the rollers 82, 83, although the third conveyor mechanism can be entirely separate, including an entirely different conveyor element 78. The rollers 82, 83 are mounted so that the centers (axes of rotation) thereof are to the right (in the direction 73) as viewed in FIG. 7 of the axes of the rollers 76, 80 (which are preferably vertically aligned, as are the rollers 77, 81) so as to horizontally deflect (in direction 73) the leading edge 25' of a mailer 67, so that it moves into a stack of the forms 67 as illustrated in FIG. 7, while the portion of the conveyor element 78 below the roller 82 continues to drive the mailer 67 downwardly. Note that the bottom periphery of the roller 81, and the conveyor element 79 moving thereon, is at the top of each form 67 in the vertical stack illustrated in FIG. 7 so that a slight horizontal push is provided to the top of each form 67 as it comes into the stack illustrated in FIG. 7, moving it in the direction 73.

Note that the first and second conveyor assemblies including the conveyor elements 78, 79 thereof are mounted so that they are substantially in face to face engagement with each other for conveying the mailer 67 between them in a first direction, typically downwardly, until deflected by the roller 82 of the third conveyor assembly. Note that the very righthand portion 82' of the roller 82 (as seen in FIG. 7) is offset in the direction 73 a predetermined distance which allows clearance of the mailers 67 between each other, for example the righthand edge 82' being offset about one-half inch with respect to the rightmost edge of the roller 80 in the direction 73 (as seen in FIG. 7) if the diameter of the roller 82 is about 1.5 inches.

The delivery device 70 includes a fourth conveyor assembly, which typically comprises a conveyance surface 85 which is perpendicular to the first direction (that is parallel to the horizontal direction 73, and perpendicular to the downward movement of the mailer 67), and stops the downward movement of the form 67 under the influence of the conveyor element 78. The conveyance surface 85 may comprise a plurality of spaced (in the dimension 73') conveyor tapes 86 as seen in FIG. 9 with a conveyor element 78 extending between them, or exteriorly of them. For example tapes 92 may pass around rollers 86, 87. The roller 86 may be powered by a motor 88 (see FIG. 9) controlled by controller 50. The motor 88 may comprise a pulsed brushless AC gear head motor. The electrical "on" pulse time, and therefore the incremental advance of the conveyor tapes 85 (and backstop 89 if provided), are set to provide vertical stacking accuracy of the mailer 67, and compliance. Typically the advance should be slightly greater than the total finished document package thickness. The capacity of the delivery conveyor 70 is essentially the operating length of the tape surfaces 85, for example about 18 inches.

The backstop 89 preferably includes a vertical support 90 (see FIG. 70) which extends downwardly below the surface of the tapes 85, between two of the tapes 85, and it is mounted on a linear bearing block 91 journalled under the top tapes 85, and guided in appropriate linear movement by the guide rod 92. The surface 89 is coupled loosely to the tapes 85, for example primarily just by the frictional engagement thereof with the tapes 85, and is urged to move with the tapes 85 in the direction 73 as the stack of documents 67 is forming as illustrated in FIG. 7.

Some documents 67 may be removed while the equipment is still operating by removing the documents and then returning the backstop 89 manually against the face of the first document 67 still left on the conveyor tapes 85. Final runout of the conveyor 70 may be accomplished manually by operator push button control (which controls the motor 88, e.g. through the controller 50).

Under some circumstances it is desirable to provide a job separating function. This may be accomplished by mounting the structures as illustrated schematically in FIG. 9, particularly the structures associated with the first and second conveyor assemblies.

As seen in FIG. 9, the roller 77 is mounted for rotation with a shaft 93, while the roller 76 is mounted for rotation with the shaft 94. The shafts 93, 94 may be splined or otherwise keyed to the rollers 76, 77 so that the rollers 76, 77 will rotate with the shafts 93, 94 but may be moved in the dimension 73' (see FIG. 9) with respect to the shafts 93, 94. In FIG. 9 the shafts 93, 94 are seen as driven by a motor 95 which drives intermeshed gears 96, 97 connected to the shafts 93, 94.

The rolls 76, 77 are typically biased to the position illustrated in FIG. 9 with respect to the shafts 93, 94 by compliant leaf spring suspensions shown schematically at 98 and 99 in FIG. 9. Means are provided for shifting the position of the rollers 76, 77 along the shafts 93, 94, however, against the bias of the leaf spring suspensions 98, 99. Such means for shifting may take a wide variety of forms, including a wide variety of different types of motors, linear actuators, cylinders, cams, gears, or the like, but in the embodiment illustrated in FIG. 9 comprises a stepper motor 100 (controlled by the controller 50) which linearly reciprocates a shaft 101 in the dimension 73', the shaft 101 connected to a cross piece 102 which engages the ends of the rollers 76, 77 opposite the leaf spring suspensions 98, 99 to effect movement of the rollers 76, 77 against the bias of the leaf spring suspensions 98, 99. Since the conveyor elements 78, 79 are urethane tapes (preferably circular in cross-section), they can readily accommodate a linear movement of a small amount (sufficient to put a clear line of demarcation between various jobs of the forms 67) without having to also shift the rollers 80, 81, 82, and 83. However if desired under certain circumstances all of the rollers 80, 81, 82 and 83 may be mounted for movement with the rollers 76, 77, or the third conveyor assembly may be made entirely separately from the second conveyor assembly so that only the rollers 80, 81 need reciprocate with the rollers 76, 77.

FIG. 9 illustrates how the job separation action works, showing the forms 67 displaced dramatically merely for clarity of illustration. For example one set of forms (one job) 103 will have a first position in dimension 73', while the next job will have a second position as illustrated at 104 in FIG. 9, etc. Typically only two different orientations 103, 104 need be provided, although the separator may be constructed so that any number of different positions within the dimension 73' may be accommodated.

An exemplary manner of operation of the entire mechanism 10 will now be described.

The system 10 is moved, by pushing the housing 11 mounted on the wheels 11', to the proper position in an office or manufacturing area, a number of paper sheets 25 having the adhesive pattern 71, 72 thereon are placed (with the adhesive patterns typically face up) in the infeed tray for the folder 13, and the folder 13 is driven by the motor 15 to V, Z, or otherwise fold the sheets 25.

The sheets 25 are passed, in sequence, in their folded configuration to the inserter 24 and grasped by the vacuum drums 29, 34 and moved downwardly by the conveyor elements 33, 37. Where an insert 26 is to be inserted into the folded sheet 25, the sensors 46, 47 operate to eventually stop the downward movement, move the folded sheet 25 back upwardly until approximately the position illustrated in FIG. 3 where the various flaps thereof are opened up, and then the motor 59 is controlled by the controller 50 to substantially linearly feed an insert 26 into the folded sheet 25 into the proper position therein within the area defined by the pressure activatable adhesive patterns 71, 72. Then the controller 50 controls the motor 41 to move the folded sheet 25, with insert 26 therein, downwardly again.

The pre-mailer thus formed is discharged from the bottom of the inserter 24 into the top of the pressure sealer 66, which effects pressure sealing of the adhesive patterns 71, 72 to form the mailer 67 (FIG. 8), which of course typically will have post office address indicia imprinted on the outside thereof (either before folding, or after completion of the handling operation by the system 10). The mailers 67 are discharged out of the bottom of the sealer 66 and are grasped by the conveyor elements 78, 79, moved into deflecting engagement with the roller 82, and moved downwardly into engagement with the conveyor surfaces 85. The tops of forms 67 are given a slight impetus in the horizontal direction 73, and a vertical stack or stacks of the form 67 are formed as illustrated in FIGS. 7 and 9. Where a job separating function is required, the sensor 75 senses bar-coding or a like indicia or marks on the mailer 67, and the stepper motor 100 is operated to shift the rolls 76, 77 to move them in the horizontal dimension 73' to put an offset between stacks (e.g. 103, 104) of mailers 67.

The stacked mailers 67 are removed, after delivery in the horizontal direction 73, adjacent the bottom of the system 10 either by running the conveyor out, or by removing groups of forms by hand and then moving the backstop 89 manually into contact with the remaining forms 67 in the vertical stack.

It will thus be seen that according to the present invention a successful, compact, and effective system and methods are provided for handling business forms, and in particular for folding, optionally inserting, pressure sealing, optionally separating, and stacking and delivering such forms. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An integrated system for folding, inserting, and pressure sealing mailer type business forms, comprising:

a common housing mounted on movable elements, said common housing mounting in or on it:

a folder for folding paper sheets with pressure-activated adhesive to form pre-mailers;

an inserter mounted for receipt of pre-mailers from said folder for inserting insert elements into the pre-mailers from said folder within areas thereof defined by the pressure-activated adhesive;

a pressure sealer module mounted for receipt of pre-mailers from said inserter for pressure sealing the pre-mailers to form mailer type business forms; and a delivery device for delivering sealed forms in one or more stacks.

2. A system as recited in claim 1 wherein said folder is mounted vertically above said inserter, said inserter is mounted vertically above said pressure sealer, and said pressure sealer is mounted vertically above said delivery device so that there is a generally downward feed of folded paper sheets.

3. A system as recited in claim 2 wherein said delivery device delivers a substantially vertical stack of forms in a substantially horizontal direction from adjacent a bottom portion of said common housing.

4. A system as recited in claim 2 further comprising a common motor for driving said folder and said sealer.

5. A system as recited in claim 1 wherein said delivery device further comprises a separator for separating the mailers into different stacked groups.

6. A system as recited in claim 5 wherein said folder is mounted vertically above said inserter, said inserter is mounted vertically above said pressure sealer, and said pressure sealer is mounted vertically above said delivery device so that there is a generally downward feed of folded paper sheets.

7. A system as recited in claim 6 wherein said delivery device delivers a substantially vertical stack of forms in a substantially horizontal direction from adjacent a bottom portion of said common housing.

8. A system as recited in claim 6 further comprising a common motor for driving said folder and said sealer.

9. A system as recited in claim 5 wherein said delivery device and separator comprise:

a first conveyor assembly comprising first and second substantially parallel rollers, and rotatable about axes, with at least one endless conveyor element extending between them;

a second conveyor assembly comprising first and second rollers substantially parallel to each other and to said first conveyor assembly rollers, and rotatable about axes, with at least one endless conveyor element extending between them;

said first and second conveyor assemblies mounted so that said conveyor elements thereof are substantially in face to face engagement with each other, for conveying a business form between them in a first direction;

a third conveyor assembly comprising a deflecting element for deflecting the leading edge of a business form exiting said first and second conveyor assemblies in the first direction to move in a second direction substantially perpendicular to the first direction, and then to continue conveyance in the first direction, said third conveyor assembly mounted immediately adjacent said first and second conveyor assemblies for receiving a business form conveyed thereby in the first direction;

a fourth conveyor assembly comprising a conveyance surface substantially perpendicular to the first direction and movable in the second direction, said conveyance surface cooperating with said third conveyor assembly to stop movement of a business form in the first direction; and means for shifting at least said first rollers of said first and second conveyor assemblies along their axes of rotation to displace them in a third direction substantially perpendicular to both the first and second directions.

10. A system as recited in claim 9 wherein said endless conveyor elements of said first and second conveyor assemblies comprise elastic conveyor elements.

11. A system as recited in claim 9 wherein said second roller of said first conveyor is mounted so as to assist in movement of a top portion of a business form in the second direction.

12. A system as recited in claim 9 wherein said at lest one endless conveyor element associated with said first and second conveyors, respectively, comprises a plurality of elastic conveyor elements associated with each.

13. A system as recited in claim 9 wherein said third conveyor assembly includes said at least one endless conveyor element from said second conveyor assembly, said at least one endless conveyor element traversing said third conveyor assembly.

14. A system as recited in claim 9 further comprising a sensor mounted on the opposite side of said third conveyor assembly from said first and second conveyor assemblies for sensing the presence or properties of a business form fed between said first and second conveyor assemblies.

15. A system as recited in claim 9 wherein said conveyor assemblies are mounted so that said first direction is substantially downward, and said second and third perpendicular directions are substantially horizontal.

16. A system as recited in claim 9 wherein said fourth conveyor assembly includes a plurality of conveyor tapes and a backstop guided for movement with said conveyor tapes in a first direction, but manually movable against that first direction.

17. A system as recited in claim 16 wherein said backstop has a support portion which extends between conveyor tapes of said fourth conveyor assembly conveyance surface, and a guide rod extending in said second direction and receiving a guide collar mounted to said backstop vertical support portion.

18. A system as recited in claim 9 wherein said folder is mounted vertically above said inserter, said inserter is mounted vertically above said pressure sealer, and said pressure sealer is mounted vertically above said delivery device so that there is a generally downward feed of folded paper sheets.

19. A system as recited in claim 1 wherein said delivery device comprises:

a first conveyor assembly comprising first and second substantially parallel rollers, and rotatable about axes, with at least one endless conveyor element extending between them;

a second conveyor assembly comprising first and second rollers substantially parallel to each other and to said first conveyor assembly rollers, and rotatable about axes, with at least one endless conveyor element extending between them;

said first and second conveyor assemblies mounted so that said conveyor elements thereof are substantially in face to face engagement with each other, for conveying a business form between them in a first direction;

a third conveyor assembly comprising a deflecting element for deflecting the leading edge of a business form exiting said first and second conveyor assemblies in the first direction to move in a second direction substantially perpendicular to the first direction, and then to continue conveyance in the first direction, said third conveyor assembly mounted immediately adjacent said first and second conveyor assemblies for receiving a business form conveyed thereby in the first direction; and a fourth conveyor assembly comprising a conveyance surface substantially perpendicular to the first direction and movable in the second direction, said conveyance surface cooperating with said third conveyor assembly to stop movement of a business form in the first direction.

20. A system as recited in claim 19 wherein said fourth conveyor assembly includes a plurality of conveyor tapes and a backstop guided for movement with said conveyor tapes in a first direction, but manually movable against that first direction.

21. A system as recited in claim 19 wherein said second roller of said first conveyor is mounted so as to assist in movement of a top portion of a business form in the second direction.

22. A system as recited in claim 19 wherein said conveyor assemblies are mounted so that said first direction is substantially downward, and said second direction is substantially horizontal.

23. A system as recited in claim 22 mounted beneath a pressure sealer for receipt of pressure sealed business forms from said pressure sealer.

24. A system as recited in claim 19 wherein said fourth conveyor assembly includes a plurality of conveyor tapes and a backstop guided for movement with said conveyor tapes in a first direction, but manually movable against that first direction.

25. A system as recited in claim 24 wherein said backstop has a vertical support which extends between conveyor tapes of said fourth conveyor assembly conveyance surface, and a guide rod extending in said second direction and receiving a guide collar mounted to said backstop vertical support.

26. A system as recited in claim 19 wherein said at least one endless conveyor element associated with said first and second conveyor assemblies comprises, in each case, a plurality of endless conveyor elements.

27. A system as recited in claim 19 wherein said folder is mounted vertically above said inserter, said inserter is mounted vertically above said pressure sealer, and said pressure sealer is mounted vertically above said delivery device so that there is a generally downward feed of folded paper sheets.

28. A system as recited in claim 1 wherein said inserter comprises:

first and second vacuum drums mounted for rotation about substantially parallel axes and each having a peripheral surface;

first and second rollers;

at least one conveyor element extending between said peripheral surface of each of said first and second vacuum drums and said first and second rollers, respectively, conveyor elements from each of said first and second vacuum drums and rollers in operative association with each other to convey a business form therebetween;

means for rotating said vacuum drums about said axes so that both of said vacuum drums are rotatable clockwise and counterclockwise;

at least one sensor for sensing the position of a business form with respect to said vacuum drums; and means for directing an insert element into a business form between said vacuum drums and held thereby.

29. A system as recited in claim 28 further comprising at least one sensor for sensing the position of an insert element associated with said means for directing an insert element into a business form.

30. A system as recited in claim 29 wherein said at least one sensor for sensing the position of a business form with respect to said vacuum drums comprises a first sensor mounted approximately at the level of said first vacuum drum, and a second sensor mounted roughly mid-way between said first vacuum drum and said first roller; and wherein said at least one sensor associated with said means for directing an insert element comprises a sensor mounted between said first and second vacuum drums.

31. A system as recited in claim 28 wherein said delivery device comprises:

a first conveyor assembly comprising first and second substantially parallel rollers, and rotatable about axes, with at least one endless conveyor element extending between them;

a second conveyor assembly comprising first and second rollers substantially parallel to each other and to said first conveyor assembly rollers, and rotatable about axes, with at least one endless conveyor element extending between them;

said first and second conveyor assemblies mounted so that said conveyor elements thereof are substantially in face to face engagement with each other, for conveying a business form between them in a first direction;

a third conveyor assembly comprising a deflecting element for deflecting the leading edge of a business form exiting said first and second conveyor assemblies in the first direction to move in a second direction substantially perpendicular to the first direction, and then to continue conveyance in the first direction, said third conveyor assembly mounted immediately adjacent said first and second conveyor assemblies for receiving a business form conveyed thereby in the first direction; and a fourth conveyor assembly comprising a conveyance surface substantially perpendicular to the first direction and movable in the second direction, said conveyance surface cooperating with said third conveyor assembly to stop movement of a business form in the first direction.

32. A system as recited in claim 28 wherein said first and second vacuum drums have approximately the same diameter and wherein said first vacuum drum axis is mounted substantially at or vertically above the upper periphery of said second vacuum drum.

33. A system as recited in claim 28 wherein said means for rotating said vacuum drums comprises means for rotating said drums so that when one of said vacuum drums rotates clockwise the other rotates counter clockwise, and vice versa.

34. A system as recited in claim 28 further comprising guides from said folder to said first vacuum drum, and between said means for directing an insert element and said second vacuum drum, for guiding a business form and insert element, respectively, into proper operative association with said vacuum drums.

35. A system as recited in claim 34 further comprising spring pressed rollers extending through said guides into contact with said vacuum drum peripheral surfaces for holding a business form onto said vacuum drum peripheries.

36. A system as recited in claim 28 further comprising spring pressed rollers into contact with said vacuum drum peripheral surfaces for holding a business form onto said vacuum drum peripheries.

37. A system as recited in claim 28 further comprising a computer controller for controlling said rotating means and said directing means in response to input received from said at least one sensor.

38. A system as recited in claim 28 wherein said directing means comprises a substantially linear support surface for supporting a substantially vertical stack of inert elements, a substantially vertical surface for engaging the leading edges of insert elements in said stack, a pair of drive rollers mounted to engage the bottom of an insert element of the bottom insert element in said stack, and an upper roller cooperating with the roller of said pair of rollers that is closest to said second vacuum drum, a single insert element being fed in the nip between said upper roller and said closest drive roller.

39. A system as recited in claim 28 wherein said conveyor element, vacuum drums, and first and second rollers are mounted so that a business form is conveyed substantially downwardly by said conveyor elements.

40. A system as recited in claim 39 wherein said inserter is mounted vertically below a folder, said folder delivering folded sheets into contact with said first vacuum drum, and then between said conveyor elements.

41. A system as recited in claim 28 wherein said folder is mounted vertically above said inserter, said inserter is mounted vertically above said pressure sealer, and said pressure sealer is mounted vertically above said delivery device so that there is a generally downward feed of folded paper sheets.

* * * * *